US005121096A

United States Patent [19]

Moore et al.

[11] Patent Number: 5,121,096

[45] Date of Patent: Jun. 9, 1992

[54] POSITION LOCATING DEVICE

[76] Inventors: Herbert A. Moore, 287 King George Dr., Flint, Mich. 48507; Al L. Wilson, 8071 Green Valley, Grand Blanc, Mich. 48439

[21] Appl. No.: 601,560

[22] Filed: Oct. 23, 1990

[51] Int. Cl.[5] ..... G08B 27/00; G08B 1/00

[52] U.S. Cl. ..... 340/326; 340/321; 340/309.15; 340/309.3; 340/691; 340/573

[58] Field of Search ..... 340/309.15, 309.2-309.5, 340/691, 571, 573, 326, 321

[56] References Cited

U.S. PATENT DOCUMENTS

| | | | |
|---|---|---|---|
| 3,931,621 | 1/1976 | Rose | 340/309.15 |
| 4,193,064 | 3/1980 | Snyder | 340/309.15 |
| 5,012,226 | 4/1991 | Love | 340/309.15 |

*Primary Examiner*—Donnie L. Crosland
*Attorney, Agent, or Firm*—Donald C. Bolger

[57] ABSTRACT

A position location device that is self powered and worn or carried by a child, pet, or a person with impaired senses such as sight or hearing. The device is a stand alone device, in that it is totally self contained and requires absolutely no external inputs of power or data. Because the device is a stand alone and not dependent on transmitted signals or radiated data, the unit is not susceptible to unwanted transient radiated noise interference or atmospheric noise phenomenon. After an adjustable preset time delay triggers a visual and audio alarm, a monitoring person can easily locate the impaired person before any potential danger occurs. A small child or a person with impaired senses carrying this device is allowed to walk or play freely. If the child or person with impaired senses walks off or gets lost, the device will automatically trigger at the preset time which will alert the monitoring person as to the location of the person.

3 Claims, 1 Drawing Sheet

POSITION LOCATING DEVICE

BACKGROUND OF THE INVENTION

The field of the invention is generally that of position locating devices, and more specifically, to an improved stand alone position monitoring device that is intended to be carried or worn by a child, pet, or person with impaired senses such as sight or hearing.

Some adults have impaired senses which requires the services of a Monitor. This Monitor must watch over and care for them all of the time. People with impaired senses often become confused and wander off and become lost. It is extremely difficult to care for these people because at certain times they are normal and then suddenly they get easily confused. A problem frequently occurs when the monitor leaves them to answer the phone, use the bathroom, or do household chores. When the monitor returns from these short interruptions, the adult with the impaired sense is nowhere to be found.

This invention solves this problem by providing a low cost device that provides a visual and audio signal for a monitor whereby the adult with the impaired senses can be easily located. This device could also be used to locate small children and pets.

SUMMARY OF THE INVENTION

Generally speaking, the present invention comprises a novel position location device. The device is worn by the subject being monitored. The device is a stand alone device, in that it is totally self contained and requires absolutely no external inputs of power or data. The device is time adjustable and it alerts a person when the preset time has expired. This stand alone device is intended to be carried or worn by a child, pet, or a person with impaired senses such as sight or hearing.

This self powered device is intended to be used as a locator and position monitoring unit, After a preset time delay triggers a visual and audio alarm, the monitoring person can easily locate the impaired person before any potential danger occurs.

As with a impaired person, the device can be used with a small child or pet. One presets the adjustable time, then the pet or child may roam about freely for this preset amount of time. If the child or pet does not return in time, the child or pet can then be easily located visually or audibly. The device has a light that flashes on and off at approximately 5 second intervals and a 2.5 KHZ frequency audio signal of 70 Db at 12 volts D.C. and can be seen or heard at distances up to 300 feet and sometimes longer. The device will operate continuously for 40 to 60 hours.

A small child or a person with impaired senses carrying this device is allowed to walk or play freely. If the child or person with impaired senses walks off or gets lost, the device will automatically trigger at the preset time which will alert the monitoring person as to the location of the person.

It is an object of the present invention to provide a novel device to monitor small children, pets, or people with impaired senses.

It is a further object of the invention to provide a novel device that will alert people in charge of caring for other when they fail to reset a position location device.

It is another object of the invention to provide a novel device that will allow one monitoring person the capability to monitor many children, pets, or people with impaired senses.

It is a further object of the invention to provide a novel device that is low cost and affordable for children, pets, or people with impaired senses.

It is another object of the invention to provide a device that uses both visual and sound to help one who is monitoring others to locate the position of those who may have left the monitoring area.

Further objects are implicit in the detailed description which follows hereinafter (which is to be considered as exemplary of, but not specifically limiting, the present invention) and said objects will be apparent to persons skilled in the art after a careful study of the detailed description which follows.

For the purpose of clarifying the nature of the present invention, one exemplary embodiment of the invention is illustrated in the hereinbelow-described figures of the accompanying drawings and is described in detail hereinafter. It is to be taken as representative of the multiple embodiments of the invention which lie within the scope of the invention.

DESCRIPTION OF THE PREFERRED EMBODIMENTS

Figure 1:
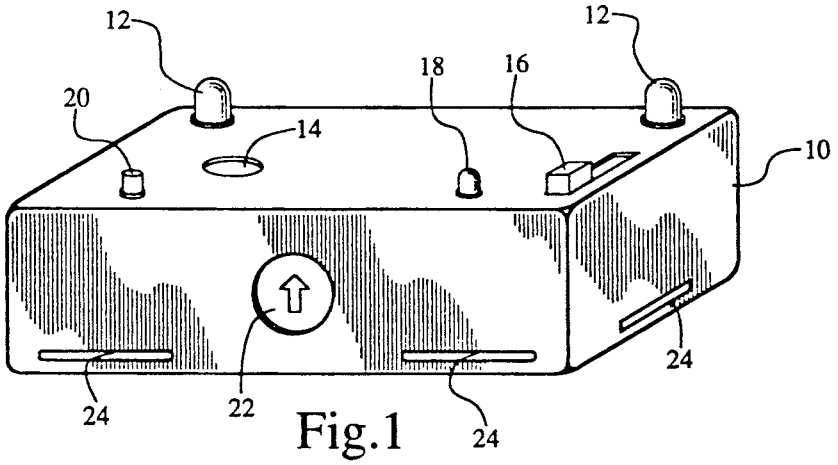
FIG. 1 is a perspective view showing one exemplary embodiment of one representative form of the invention.

Referring to FIG. 1, box 10 with slots 24 is used to hold the components of the position locating device. Slots 24 are used for securing straps or belts to the unit. Two output light bulbs 12 are mounted on box 10 so that output light bulbs 12 can be seen for 300 feet or more. Audio alarm 14 pulses at the same rate as output light bulbs 12 and audio alarm 14 can be heard for 300 feet or more. Battery test light bulb 18 is used to indicate that the device is operative.

First switch 16 (S1) is a slide switch used to turn the device off and on. First switch 16 (S1) also has a instant reset feature. Second switch 20 (PB1) is a dual purpose switch used to test output light bulbs 12 and audio alarm 14. If battery test light bulb 18 is barely visible when second switch 20 (PB1) is depressed, the device will need maintenance such as a new d.c. voltage source B1 (battery B1). Time delay switch 22 changes resistor R2 and is recessed for safety and has an adjustment for establishing pre-set time delays.

When the device is activated output light bulbs 12 flash on for one second and off for 5 seconds and then repeats. Audio alarm 14 sounds at the same time as output light bulbs 12 at 2.5 KHZ of 70 Db at 12 volts D.C. By turning time delay switch 22 the delay can be varied from 5 minutes to sixty minutes. Once battery test light bulb 18 becomes dim, the device will continue to function an additional 10 to 20 hours in a reserve mode which acts as a safety feature.

Figure 2:
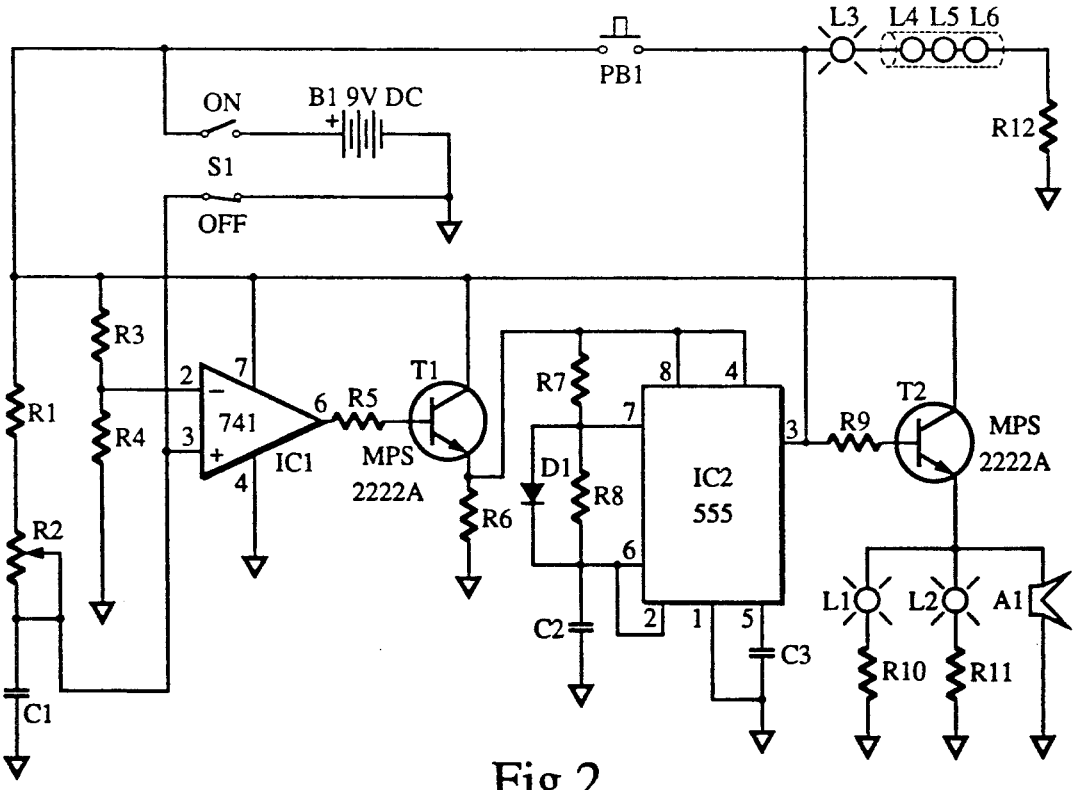
FIG. 2 is a circuit diagram showing one exemplary embodiment of one representative form of the invention.

Referring to FIG. 2, the unit is activated by first switch S1 (slide switch 16 in FIG. 1). With first switch S1 in the on position, 9 volts D.C. is applied to the automatic timing circuit. This timing circuit consists of resistor R1, resistor R2, and capacitor C1. Current flows from ground, charging capacitor C1 through resistor R2 and resistor R1 to the positive pole of the battery B1 through first switch S1. In the charging circuit resistor R2 is adjustable and by pre-setting resistor R2, one can control the timing thereby establishing the delay time before the units alarms are activated.

When power is first turned on, current flows from ground through resistor R4 and resistor R3 to the positive pole of the battery B1 through first switch S1. At the junction of resistor R3 and resistor R4, a voltage drop is developed across resistor R4 and applied to pin 2 of amplifier IC1, which is the negative input summing junction. This voltage applied to pin 2, through resistor R3 and resistor R4, establishes the quiescent bias point of amplifier IC1.

The current flowing from ground through capacitor C1 through resistor R1 and adjustable resistor R2 develops a charging voltage on the high side of capacitor C1 and applies this rising voltage to pin 3 (positive summing junction) of amplifier IC1 (whose output is being held low).

When the charging voltage at pin 3 of amplifier IC1 becomes greater than the voltage at pin 2, amplifier IC1 changes state, from low to high and applies this positive going signal to the base of transistor T1 through resistor R5. Base current of transistor T1 is controlled by the resistance valve of resistor R5. Transistor T1 is a N.P.N. transistor wired to serve as an emitter follower to insure that the output of transistor T1 experiences no phase inversion and may be directly applied to pin 8 and pin 4 of timer IC2. Resistor R6 serves in this emitter follower as the load resistor for transistor T1, as current flows through resistor R6, a voltage is developed across resistor R6 and is applied again to pins 8 and 4 of timer IC2.

With this signal applied to pins 8 and 4, and ground applied to pin 1, current flows from ground through capacitor C2, resistor R8, diode D1, and resistor R7 through transistor T1 and first switch S1 to the positive pole of battery B1, causing timer IC2 to oscillate at frequency established by capacitor C2, resistor R8, diode D1, resistor R7 and capacitor C3, this frequency is a fixed frequency which will be applied to all visual indicators output light bulb L1 and output light bulb L2 and audio generator A1. The duty cycle of this frequency has been designed to be non-symmetrical to control on time as compared to off time (blinking rate), to be off for the most part of the duty cycle to insure highest performance from battery B1.

This frequency generated by timer IC2 is applied to be base of transistor T2 through resistor R9 (current limiting) and as transistor T2 is also wired as a N.P.N. emitter follower this frequency may be directly applied to output light bulb L1, output light bulb L2, and audio generator A1. In this configuration output light bulb L1, output light bulb L2, and audio generator A1 act as the load for transistor T2. Output light bulb L1, output light bulb L2, and audio generator A1 will blink and sound at the rate established by timer IC2.

When test button of second switch PB1 (Dual Purpose Switch 20, FIG. 1) is depressed output light bulb L1, output light bulb L2, and audio generator A1 will blink and sound as a test feature built in to insure alarms are working. Output light bulb L1, output light bulb L2, and audio generator A1 will activate through transistor T2, resistor R9 and second switch PB1. By depressing second switch PB1, a battery sample test will also occur, lighting battery test light bulb L3 through optional battery test light bulb L4, option battery test light bulb L5, optional battery test light bulb L6 and resistor R12 to ground. When the battery B1 is at full strength (9 volts) battery test light bulb L3 appears at full intensity, as battery B1 decays from 9 volts to 6.5 volts light intensity will diminish. Battery test light bulb L3 will remain bright enough to see down to 6.5 volts where at 6.5 volts it will appear to be very dim. It is at this point we recommend that the battery be changed although the unit now has a built in reserve (battery B1—from 6.5 volt down) to operate for another 10 plus hours, acting as a safety feature.

Instantaneous reset will occur when the unit is shut off through first switch S1. The second pole of first switch S1 in the off position applies ground to pin 3 of amplifier IC1 thereby causing pin 6 of amplifier IC1 to go back to a low state, shutting off the oscillation, stopping the alarms.

What is claimed is:

1. A automatic timing circuit for a position locating device which comprising:

a d.c. voltage source, having a positive and negative terminal;

a first switch whereby said d.c. voltage source is connected and disconnected from said automatic timing circuit;

a first resistor;

a second resistor having an adjustment whereby said resistor can act as a potentiometer;

a first capacitor;

means for connecting said first resistor between said second resistor and the positive terminal of said d.c. voltage source;

means for connecting said second resistor between said first resistor and said first capacitor;

means for connecting said first capacitor between said second resistor and ground;

a amplifier I.C. having connection terminals at two, three, four, six, and seven;

a third resistor;

a fourth resistor;

a fifth resistor;

means for connecting said third resistor between the positive terminal of said d.c. voltage source and said fourth resistor;

means for connecting said fourth resistor between said third resistor and ground;

means for connecting said amplifier I.C. terminal two at a junction between said third resistor and said fourth resistor;

means for connecting said amplifier I.C. terminal three at a junction between said second resistor and said first capacitor;

means for connecting said amplifier I.C. terminal three to the off side of said first switch;

means for connecting said amplifier I.C. terminal four to ground;

means for connecting said amplifier I.C. terminal seven to the positive terminal of said d.c. voltage source;

a first transistor having a base, a collector and an emitter;

a sixth resistor;

means for connecting said fifth resistor between said amplifier I.C. terminal six and said first transistor base;

means for connecting said first transistor collector to the positive terminal of said d.c. voltage source;

means for connecting said sixth resistor between said first transistor emitter and ground;

a timer I.C. having terminals at one, two, three, four, five, six, seven, and eight;

a seventh resistor;

a eighth resistor;

a first diode;

a second capacitor;

a third capacitor;

means for connecting said timer I.C. terminals four and eight between the junction of said first transistor emitter and sixth resistor;

means for connecting said first end of said seventh resistor to timer I.C. terminals four and eight;

means for connecting said second end of said seventh resistor to timer I.C. terminal seven;

means for connecting said eighth resistor between timer I.C. terminals six and seven;

means for connecting said first diode between timer I.C. terminals six and seven;

means for connecting said second capacitor between ground and timer I.C. terminals two and six;

means for connecting said third capacitor between ground and timer I.C. terminal five;

means for connecting said timer I.C. terminal one to ground;

a ninth resistor;

a second transistor having a base, collector and emitter;

at least one output light bulb;

at least one output light bulb resistor for each said output light bulb;

at least one audio generator;

means for connecting said ninth resistor between said timer I.C. terminal three and said second transistor base;

means for connecting each said output light bulb in series with each said output light bulb resistor between said second transistor emitter and ground;

means for connecting each said audio generator between ground and second transistor emitter;

at least one battery test light bulb;

at least one battery test light bulb resistor for each battery test light bulb;

a second switch;

means for connecting said battery test light bulb in series with each said battery test light bulb resistor between said the first side of said second switch and ground;

means for connecting said second side of said second switch to the positive terminal said first switch;

means for connecting said first side of said second switch to said timer I.C. terminal three;

said I.C's, transistors, diode, resistors, capacitors having parameters selected so that, when said first switch is in the "on" position the charging circuit is pre-set by adjusting said second resistor for establishing a delay time before said audio generator and said first light bulb and said second light bulb are activated.

2. A device as recited in claim 1, further including a box having slots for attaching purposes.

3. A device as recited in claim 1, wherein at least one capacitor is added to said first capacitor in parallel.

* * * * *